US006102976A

United States Patent [19]

Oji et al.

[11] Patent Number: 6,102,976

[45] Date of Patent: Aug. 15, 2000

[54] EXHAUST GAS PURIFIER

[75] Inventors: Masataka Oji; Hidetoshi Saito; Shiro Nakajima; Satoru Okamoto, all of Hyogo, Japan

[73] Assignee: Sumitomo Electric Industries, Ltd., Osaka, Japan

[21] Appl. No.: 09/081,988

[22] Filed: May 21, 1998

[30] Foreign Application Priority Data

May 21, 1997 [JP] Japan ..... 9-130216

[51] Int. Cl.[7] ..... B01D 46/00

[52] U.S. Cl. ..... 55/282.3; 55/466; 55/482; 55/DIG. 10; 55/DIG. 30

[58] Field of Search ..... 55/282.3, 466, 55/525, 482, DIG. 30, DIG. 10; 60/311

[56] References Cited

U.S. PATENT DOCUMENTS

| | | | |
|---|---|---|---|
| 4,318,720 | 3/1982 | Hoggatt | 55/DIG. 30 |
| 4,345,431 | 8/1982 | Suzuki et al. | 55/DIG. 30 |
| 4,813,231 | 3/1989 | Bykowski | 55/DIG. 30 |
| 4,829,766 | 5/1989 | Henkel | 60/303 |
| 5,044,157 | 9/1991 | Henkel | 55/466 |
| 5,228,891 | 7/1993 | Adiletta | 55/DIG. 30 |
| 5,458,664 | 10/1995 | Ishii et al. | 55/DIG. 30 |
| 5,620,490 | 4/1997 | Kawamura | 55/DIG. 30 |
| 5,782,941 | 7/1998 | Matsunuma et al. | 55/DIG. 30 |

FOREIGN PATENT DOCUMENTS

| | | |
|---|---|---|
| 0 603 392 | 6/1994 | European Pat. Off. . |
| 1-66418 | 4/1989 | Japan . |
| 6-257422 | 9/1994 | Japan . |

OTHER PUBLICATIONS

Patent Abstracts of Japan vol. 096, No. 010, Oct. 31, 1996 & JP 08 151919 A (Sumitomo Electric Ind Ltd) Jun. 11, 1996 *Abstract.

*Primary Examiner*—Duane S. Smith
*Attorney, Agent, or Firm*—Sughrue, Mion, Zinn, Macpeak & Seas, PLLC

[57] ABSTRACT

An exhaust gas purifier which can efficiently eliminate particulate matter discharged from an engine, and which has a long life. The purifier is attached to a discharge passage of an engine, and includes a filter constituted by a plurality of cylindrical filter elements each formed of porous metal. The filter elements are different in diameter from each other, and disposed concentrically and assembled radially apart from each other through a space. The filter has an exhaust gas inlet passage side end and an exhaust gas outlet passage side end, the exhaust gas inlet side end being closed, by a shielding plate, up to the cylindrical filter element of the largest outer diameter, and the exhaust gas outlet passage side end being closed at a portion between an outer circumferential case and the cylindrical filter element of the smallest outer diameter. The exhaust gas purifier further includes a plate-like heater disposed between the filter element of the largest outer diameter and the filter element disposed inside and adjacent to the filter element of the largest outer diameter without contacting with the two filter elements. Preferably, three-dimensional mesh porous metal having the same average pore-size is used as a material for each of the cylindrical filter elements.

2 Claims, 3 Drawing Sheets

EXHAUST GAS PURIFIER

BACKGROUND OF THE INVENTION

The present invention relates to an exhaust gas purifier for eliminating particulate matter contained in exhaust gas of an engine which is installed in a car, an industrial machine or the like, and which uses petroleum fuel as energy.

An engine using petroleum fuel as energy burns the fuel to convert it into mechanical energy. However, exhaust gas discharged from the engine partially contains particulate matter (hereinafter abbreviated to "PM") mainly containing carbon because of incomplete combustion. If such PM is discharged as it is, air pollution is caused.

Various techniques for eliminating PM in such exhaust gas, particularly PM in exhaust gas of a Diesel engine, have been introduced.

However, exhaust gas discharged from an engine is high in temperature, and contains corrosive gas such as SOx. Accordingly, the material of a filter has been difficult to select. In addition, PM in the exhaust gas includes very small particles. Accordingly, attention has been paid also to the fineness of the mesh of the filter.

Typically, ceramic foam of cordierite has been used as a material, and this ceramic foam is formed into a honey-comb shape. This ceramic foam material has such a fine mesh as to trap PM more securely and advantageously than other materials having a mesh which is not so fine. However, this material needs to have more effective area for trapping PM because its fineness of mesh is rather disadvantageous with respect to the quantities of PM to be trapped. Therefore, it is necessary to form the material into a honey-comb shape such that a more effective area for trapping PM will be obtained. With respect to this material, there is another disadvantageous problem that will be observed when the trapped PM is burned and regenerated. If this material is heated locally by such burning and regeneration of PM, cracks or melting loss are likely to occur.

Recently, such series of porous metal as Cr—Al, Ni—Cr—Al, or Fe—Ni—Al have been developed to be use for the materials of filters. These materials have an advantage in that they do not cause local heating which is a weak point of the above-mentioned cordierite and regeneration can be attained by uniform heating. However, when their mesh is made as fine as the ceramic foam, a very heavy filter is produced because of a difference in specific gravity between the materials. Therefore, various contrivances have been utilized for the structure of a filter.

As for the structure of a filter, Japanese Patent Unexamined Publication No. Hei-6-257422 discloses a structure in which two or four piled cylindrical filter elements respectively made from three-dimensional mesh-structure porous metal are used, and a heater is installed between the filter elements. Advantageously, this filter can burn and regenerate trapped PM very effectively and uniformly, and, in addition, has a long life. However, the filter does not have such a fine mesh as the ceramic foam because of the characteristic of its material. In addition, in structure, exhaust gas passes the respective filter elements only once. Accordingly, the performance to trap PM in the exhaust gas is not satisfactory.

Japanese Utility Model Unexamined Publication No. Hei-1-66418 discloses another method in which a plurality of cylindrical filter elements are combined, and the roughness of meshes of the filter elements are made different from each other to thereby eliminate PM in exhaust gas effectively, though nothing is referred to about material to be used.

In this method, the filter element on the exhaust gas inlet side is designed to have a rough mesh and a large area to trap, while the filter element on the exhaust gas outlet side is designed to have a fine mesh and a small area to trap. In such a manner, large particles in the exhaust gas are eliminated by the former, that is, the rough-mesh filter element, while small particles in the exhaust gas are eliminated by the latter, the fine-mesh filter element.

Though this is a good idea, the PM trapping quantities of the respective filter elements are different from each other in accordance with the size of the PM particles in the exhaust gas. As a result, the performance of pressure loss of the filter due to the exhaust gas is dominated by one of the filters which is inferior in the performance of pressure loss.

In addition, in order to eliminate PM of smaller particle size, it is necessary to make the meshes of the latter filter element finer. The performance of pressure loss is dominated by this fine-mesh filter element on the outlet side. Further, since the above-mentioned prior art does not disclose any means for regeneration, it is not practical in use.

As has been described above, a purifier for engine exhaust gas may be produced for practical use, but it still leaves room for improvement.

Particularly, it is expected to provide a long-life purifier which can continuously and repeatedly perform trapping of PM in exhaust gas and burning/regenerating of the trapped PM in a state where the purifier is left as it is attached to a discharge passage of the exhaust gas.

To provide such a purifier, the performance to trap PM in exhaust gas must be improved, but, at the same time, the performance of the regeneration must be improved because it largely affects the life of the purifier.

A purifier which can balance these performances with improved efficiency is required. First, with respect to the material to be used, in order to make regeneration stable and make the life of the purifier long, material, such as ceramics, having a low coefficient of thermal conductivity is not suitable. In the case of metal material, it is necessary to increase volume porosity in order to solve the problem of large specific gravity. However, if the volume porosity is made too large, the trapping performance is lowered, and, at the same time, the size of the purifier is increased.

On the contrary, if the volume porosity is made small, the pressure loss of the filter due to exhaust gas is increased. In this case, it is necessary to increase the trapping area correspondingly, so that the purifier increases in size. However, if a purifier is made large in its size for the above reason, it would be inconvenient to use such a purifier for purifying the exhaust gas emitted from an engine since the space for mounting the purifier on a vehicle is so limited.

SUMMARY OF THE INVENTION

As has been described above, it is an important object to provide an exhaust gas purifier which is practical, compact, and long in life.

According to the present invention, provided is an exhaust gas purifier characterized in that the purifier is attached to a discharge passage of exhaust gas discharged by the operation of an engine, and comprises a filter constituted by a plurality of cylindrical filter elements each formed of porous metal, the filter elements being different in diameter from each other, the filter elements being disposed concentrically and assembled radially apart from each other through a space, the filter having an exhaust gas inlet passage side end and an exhaust gas outlet passage side end, the exhaust gas inlet side end being closed with a disk-like member up to the cylindrical filter element of the largest outer diameter, the exhaust gas outlet passage side end being closed at a portion between an outer circumferential case and the cylindrical filter element of the smallest outer diameter, the exhaust gas purifier further comprising a plate-like heater disposed between the filter element of the largest outer diameter and the filter element disposed inside and adjacent to the filter element of the largest outer diameter without contacting with the two filter elements. By the combination of such material and structure, it is possible to provide an exhaust gas purifier which is practical, compact, and long in life.

In the above exhaust gas purifier, three-dimensional mesh-like porous metal having the same average pore-size is used as a material for each of the filter elements of the cylindrical filter. With this arrangement, a difference in clogging between the filter elements is eliminated to thereby ensure the performance of pressure loss.

In the above exhaust gas purifier, it is preferable to increase thicknesses of the filter elements of the cylindrical filter as the cylindrical diameters thereof are decreased. With this arrangement, it is possible to improve the trapping performance without making the meshes of the filter elements fine, and it is possible to increase the PM trapping quantity as well.

DETAILED DESCRIPTION OF THE INVENTION

Figure 1:
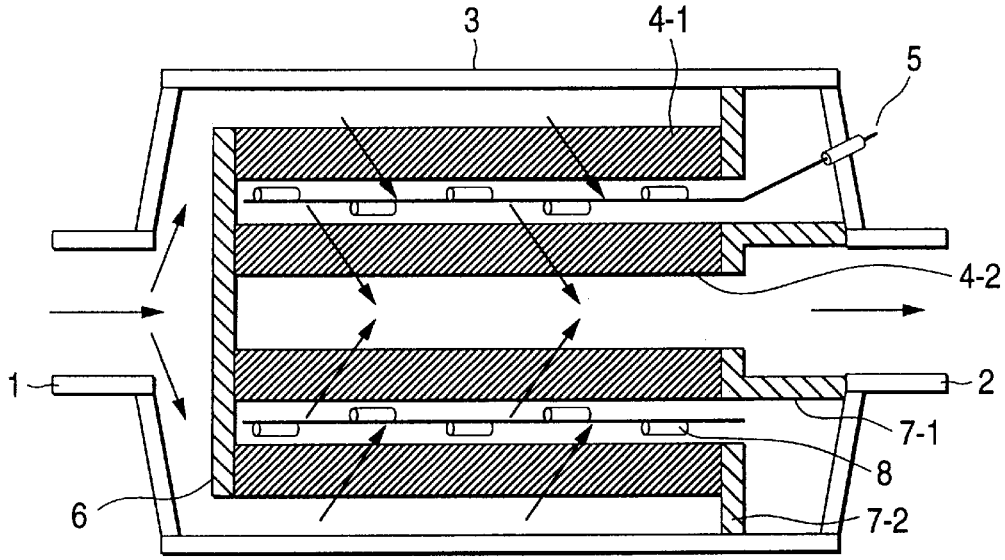
FIG. 1 is a sectional view of a first example of the present invention.

A filter according to the present invention is made up of a plurality of cylindrical filter elements (4-1, 4-2, 14-1, 14-2, 14-3) having respective different diameters and arranged concentric to each other. A disk-like shielding plate (6) is attached to a longitudinal end (i.e., a exhaust gas inlet passage side end) of the filter to close that end. The disk-like shielding plate (6) has a diameter substantially equal to an outer diameter of the filter element (4-1, 14-1) of the largest outer diameter, and therefore the exhaust gas which has entered from an exhaust gas inlet (1) flows and diffuses along an inner wall of a filter case (3) so that the exhaust gas uniformly enters into the filter element (4-1, 14-1) from the entire outer circumferential surface of that filter element (4-1, 14-1). A shielding plate (7-1) is attached to an end of a filter element (4-2, 14-3) of the smallest outer diameter at the other longitudinal end (i.e., an exhaust gas outlet passage side end) of the filter. The shielding plate (7-1) is also affixed and sealed up to the inner wall of the filter case (3), and therefore, all of the exhaust gas is discharged through an exhaust gas outlet (2) after having been purified by that filter element (4-2, 14-3) of the smallest outer diameter. Similarly, a shielding plate (7-2) is attached to both an end of the filter element (4-1, 14-1) of the largest outer diameter and the inner wall of the filter case (3) so that all of the exhaust gas which has entered from the exhaust gas inlet (1) is purified by that filter element (4-1, 14-1) of the largest outer diameter.

The material of the each filter element (4-1, 4-2, 14-1, 14-2, 14-3) is porous metal which is superior in heat conductivity in comparison with ceramic material. Therefore, when the material is burned and regenerated, even if trapped PM is not uniform, heat is diffused through the skeleton structure of the filter element in the case where the PM is heated by a plate-like heater and self-burned. Therefore, the filter element is hardly overheated locally, so that cracks or melting loss can be prevented from occurring.

As the porous metal, it is preferable to use three-dimensional mesh-like porous metal obtained particularly by plating foamed urethane with metal, and then burning and eliminating the resin component contained in such foamed urethane. This three-dimensional mesh-like porous metal traps PM in exhaust gas three-dimensionally. Therefore, if the thickness of the filter element is increased, it is possible to improve the PM trapping quantity per unit surface area.

In manufacturing a cylindrical filter element, the thickness of the filter element may be adjusted by winding up concentrically such a sheet of three-dimensional mesh-like porous metal as piled up each on the top of another.

As for the composition of the metal, preferably, an Ni—Cr—Al alloy, an Fe—Cr—Al alloy, and an Fe—Ni—Cr—Al alloy are used because of their superiority in heat resistance and corrosion resistance. The alloy obtained by diffusing Cr and Al in CELMET (registered trademark) made of Ni, manufactured by Sumitomo Electric Industries, Ltd., is particularly preferable.

Figure 4:
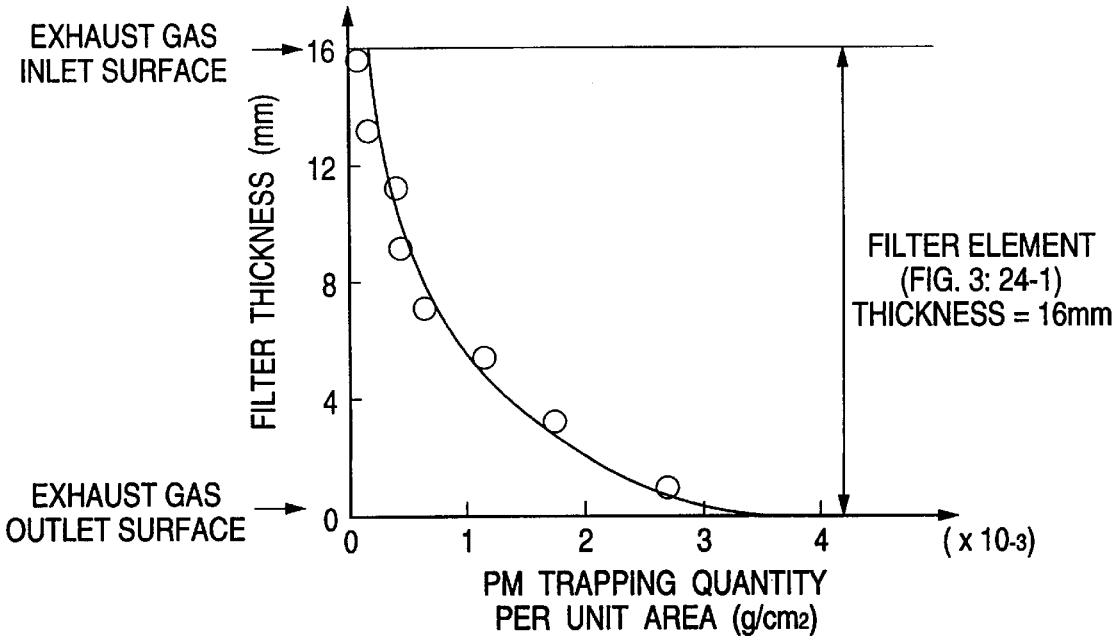
FIG. 4 is a graph showing a PM trapping quantity per unit area of a filter element in the comparative example.

Providing multiple stages of cylindrical metal filter elements in a flow of exhaust gas is more advantageous than using only one stage of a thicker filter element in the following points. First, PM is trapped not only by the surface of the filter element but also inside the filter element. If the filter element is too thick, the quantity of PM accumulated in the depth direction of the filter element is apt to concentrate in the front surface, and the neighborhood of the back surface of the filter element is difficult to contribute to trap. This state is shown in FIG. 4.

Figure 5:
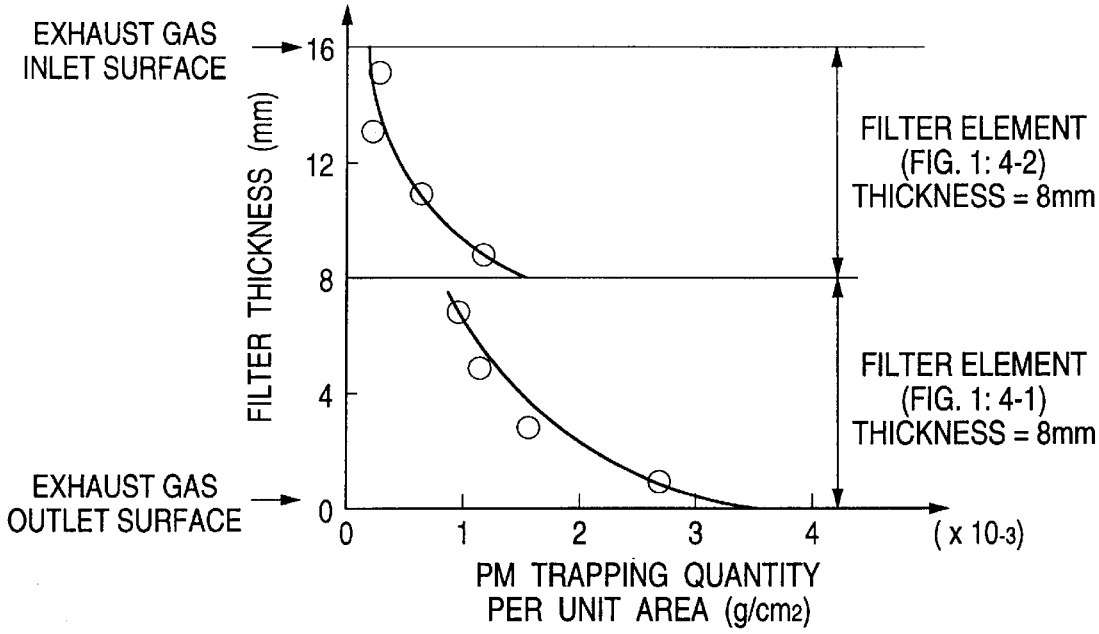
FIG. 5 is a graph showing a PM trapping quantity per unit area of a filter element in the first example of the present invention.
Figure 6:
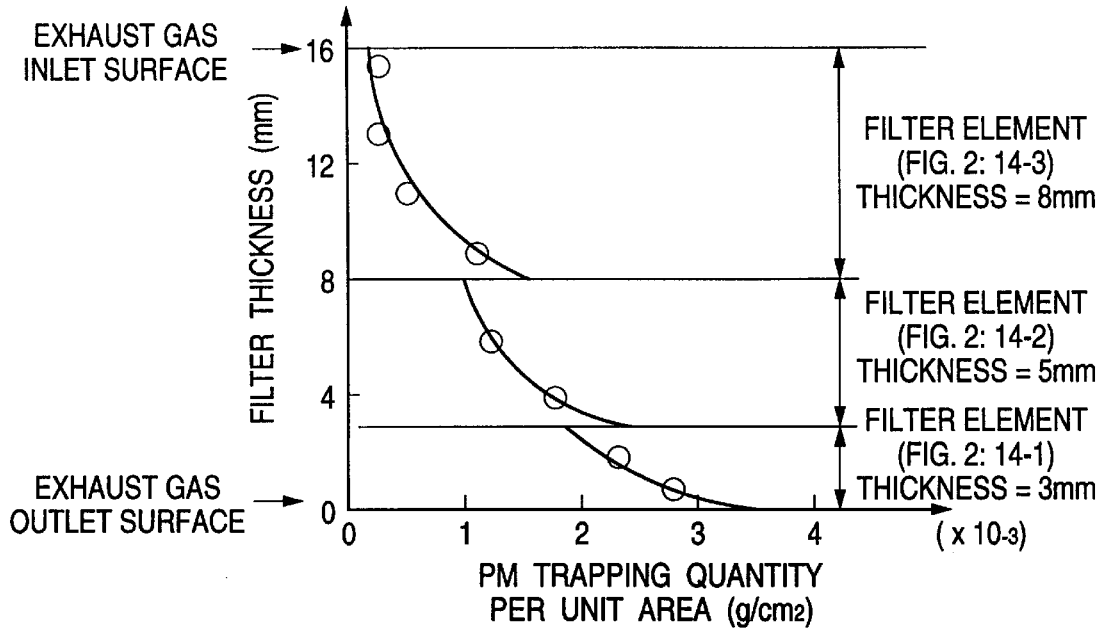
FIG. 6 is a graph showing a PM trapping quantity per unit area of a filter element in the second example of the present invention.

However, if a double or triple-stage filter constituted by two or three filter elements is used so that the sum of their thickness is equal to the thickness of the above-mentioned single filter element, the total amount of PM trapped by the first, second and third filter elements is more than that of the one-stage filter, as shown in FIGS. 5 and 6. Consequently, the PM trapping efficiency is enhanced to a great extent. Further, by preventing the filter element from clogging locally in the thickness direction, and increasing the PM trapping quantity, it is possible to use the filter element for a longer period of time and as a result, it is possible to extend the interval of regeneration of the filter.

Secondly, a regenerating heater can be set between the filter elements. If the filter element is thick, radiation heat is transmitted mainly to the surface of the filter element opposite to the heater no matter how hot the heater heats the filter, and the filter can not reach a predetermined temperature easily so that it takes a long time for regeneration.

Thirdly, to manufacture a metal filter element, it is preferable to give a final shape to the filter in the stage of alloy of Ni, Fe, Fe—Cr, Ni—Fe—Cr or the like which is easy to finish, and to add Cr and Al to the alloy by diffusion alloying.

If one filter element is thicker in this diffusion alloying process, the diffusion is apt to be non-uniform so as not to be preferred in the working process.

A plate-shaped heater is used to burn and eliminate the trapped PM. It is important to heat the whole filter at a uniform temperature. It is preferable that the heater is disposed in a place between the filter element having the largest outer diameter and another filter element located inside and adjacent to the first-mentioned filter element. This was the fact derived from the measurement of temperature distribution by use of the heat generated by the combustion of trapped PM, the heat of the heater, and the flow of a small amount of exhaust gas or air at the time of regeneration. If the plate-like heater touches the filter at this time, an electric current flows to the filter element. This is dangerous, and causes the local heating of the filter element. It is therefore preferable to set the heater at a distance from the filter element.

By making all the filter elements have the same pore size, it becomes easy to manufacture the filter elements, and the filter elements can be used without concentration of pressure loss on a filter element. As a result, it is possible to increase the PM trapping quantity. Preferably, PM can be trapped sufficiently not only by a large diameter filter element which is the one near the exhaust gas inlet side but also by a small diameter filter element.

Then, the smaller the pore size of the filter element is, the more improved the trapping efficiency can be. However, if the pore size is made too small, the pressure loss of exhaust gas is undesirably so large that back pressure is given to an engine. In view of the PM trapping performance and the back pressure effect against the engine, a filter element having the optimum pore size of about 0.1 to 0.6 mm may be used particularly preferably.

The thickness of each filter element is preferably set within the region of from 0.5 to 20 mm, more preferably 1 mm or more from the view-point of practical durability.

In addition, though the thickness of each of a plurality of filter elements having different diameters from each other can be established desirably, it is preferable to make the thicknesses of the cylindrical filter elements larger as the cylindrical diameters thereof are decreased, from the point of view of improving the trapping and pressure-loss performance. The reason will be described below. Exhaust gas flows in through the outer surface of the largest outer diameter filter element, and flows out through the inner surface of the smallest outer diameter filter element. PM is trapped whenever the exhaust gas passes the filter elements. Therefore, the smaller the outer diameter of the filter element, the less the PM quantity in the exhaust gas passing a filter element and thus the smaller the trapped PM quantity. Therefore, if all the filter elements have the same thickness, the smaller outer diameter filter element does not trap PM effectively, in comparison with the larger outer diameter filter element. Accordingly, if the cylindrical filter element having a smaller outer diameter is made thick as in the above structure, the trapping quantity in the thickness direction can be increased by the three-dimensional trapping effect, and all the filter elements can trap PM effectively.

EXAMPLES

FIG. 1 is a schematic diagram of a first example of an exhaust gas purifier. Exhaust gas (designated by the arrow) which was discharged from an engine entered the exhaust gas purifier. The exhaust gas came into a filter case 3 through an exhaust gas inlet 1. The exhaust gas went round the neighborhood of the inner wall of the filter case 3 by means of a shield plate 6 provided on a filter end portion. PM was trapped in a first filter element 4-1, passed through the gap of a plate-like heater 5 having insulators 8, and was further trapped in a second filter element 4-2. Then, the gas, which was purified so as to be free from PM, was discharged through an exhaust gas outlet 2. Each of the filter elements used herein was made to be 8 mm thick. In addition, the insulator 8 surely prevented the filter elements 4-1 and 4-2 from contacting with the heater 5.

In general, since the exhaust gas purifier of this type needs to alternately perform trapping and regeneration, two or more sets of such exhaust gas purifiers are attached to one exhaust gas passage so that while one set performs regeneration, the other set performs trapping, and this operation is switched alternately. With this arrangement, trapping and regeneration can be performed without detaching the purifiers.

In the purifier according to the present invention, the filter case 3 acting as an outer shell, and the shield plates 6 and 7 (7-1, 7-2) were made of stainless steel. The filter elements 4-1 and 4-2 were formed from CELMET (registered trademark) product No. #7 manufactured by Sumitomo Electric Industries, Ltd., which was made cylindrical and thereafter alloyed into an Ni—Cr—Al alloy with Cr and Al by a diffusion alloying method. An Fe—Cr—Al alloy was used for the plate-like heater 5.

Figure 2:
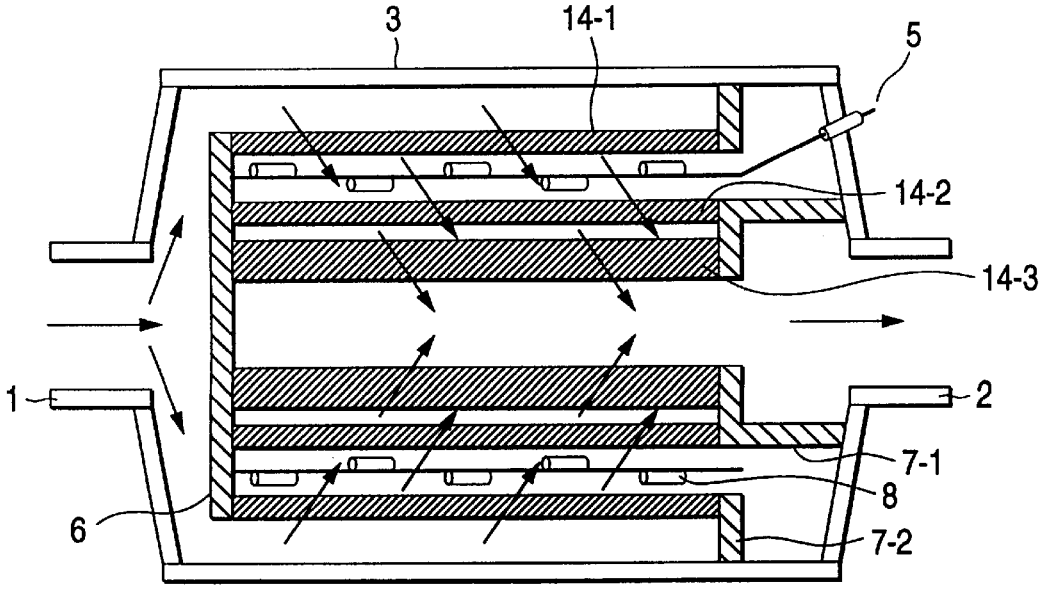
FIG. 2 is a sectional view of a second example of the present invention.

FIG. 2 is a schematic diagram of a second example of the present invention. Although the outline of the purifier was almost the same as that in the first example, filter elements set therein were made thicker in the order of passing of the exhaust gas through the filter elements. In this example, a first filter element 14-1 was made 3 mm thick, a second filter element 14-2 was made 5 mm thick, and a third filter element 14-3 was made 8 mm thick.

Figure 3:
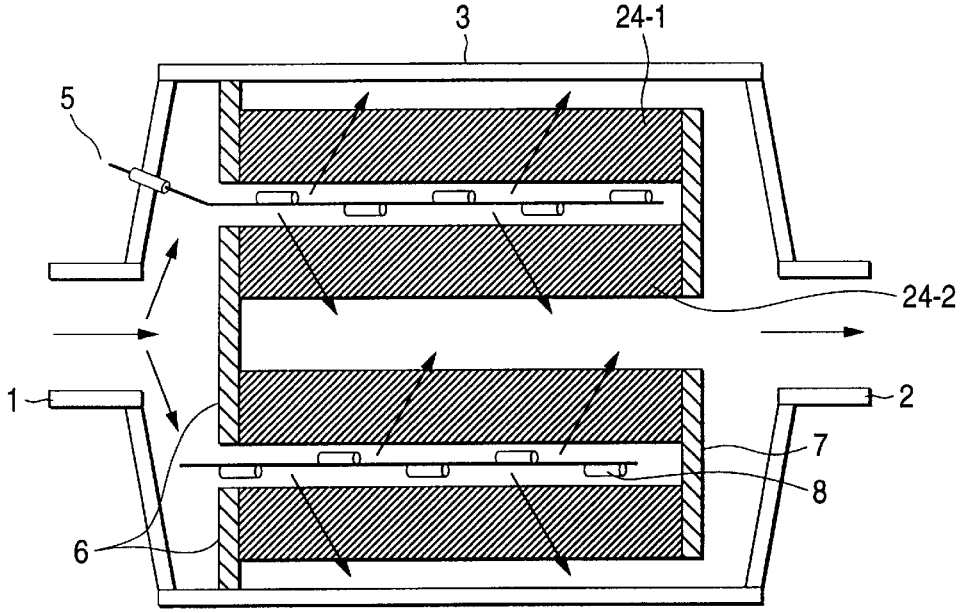
FIG. 3 is a sectional view of a comparative example of an exhaust gas purifier.

FIG. 3 shows a comparative example. In this comparative example, exhaust gas was intended to be trapped between filter elements 24-1 and 24-2 constituting a double structure, and a heater was set in the center portion between the filter elements 24-1 and 24-2. As the thickness of the filter elements, each of the outer cylindrical filter element 24-1 and the inner cylindrical filter element 24-2 was made 16 mm thick correspondingly to the total sum of the three filter elements used in the second example. The filter elements were manufactured so that each of the filter of first, second and comparative examples has an effective area of 0.064 $m_2$. These data are shown in Table 1.

TABLE 1

| Item | Example 1 | Example 2 | Comparative Example 1 |
|---|---|---|---|
| filter arrangement | double, series | triple, series | double, parallel |
| thickness of filter passed by exhaust gas (mm) | 16 (8 + 8) | 16 (3 + 5 + 8) | 16 |
| filter total weight (g) | 850 | 1,000 | 1,010 |
| effective filter area ($m^2$) | 0.064 | 0.064 | 0.064 |
| filter largest outer diameter (mm) | 92 | 92 | 102 |
| trapping efficiency (%) | 75 | 75 | 75 |
| trapped PM amount (g) when pressure loss reaches 30 kPa | 12 | 13.5 | 10.5 |

TABLE 1-continued

| Item | Example 1 | Example 2 | Comparative Example 1 |
|---|---|---|---|
| heater conducting power in regeneration (kw·min) | 1 × 10 | 1 ×10 | 1 × 15 |
| regeneration rate (%) | 65 | 80 | 50 |

From Table 1, the total sum of the thickness of the filter was 16 mm in the first and second examples and the comparative example, and pressure loss was also equal. However, there were a difference in trapping quantity, and a difference in degree of recovery (regeneration rate) in regeneration.

As shown in the results, according to the present invention, it was possible to increase the PM trapping quantity and to improve the regeneration rate. It was therefore possible to increase the interval between regenerations. As a result, it was possible to prolong the life of a filter, and it was also possible to reduce the heater conducting power per unit time.

As for the measurement of PM quantities deposited in the filters in the direction of the depths of filters in Example 1, Example 2 and Comparative Example, the operation of purifiers was stopped prior to the start of regeneration in the purifiers after such PM had been trapped. Since a filter element is composed of such sheets of a metal as wound and piled up each on top of another, the filter element may be separated into the sheets each one of which can be examined for the measurement of the PM quantities deposited on each of such sheets.

FIG. 4 shows the results obtained from the measurement made on the comparative example, in which the PM quantity was distributed largely in the direction of thickness of the filter element so that the filter element was not used sufficiently in the direction of thickness. FIG. 5 shows the results obtained from the measurement made on Example 1. From this FIG. 5, it can be said that a filter which is furnished with two cylindrical filter elements are evidently more effective to trap a larger amount of PM than the filter of comparative example. It can also be said that each filter element in such a filter having two cylindrical filter elements is sufficiently useful to trap PM in the direction of depth of such a filter element. In addition, it is apparent from FIG. 6 that such a multiple type of filter as furnished with three cylindrical filter elements placed in a filter is still more effective and advantageous to trap a much larger amount of PM than the filter of comparative example.

Effects of the Invention

As shown in the examples, the trapping performance is satisfactory because of a multiplex filter structure, and regeneration by a plate-like heater is also performed effectively. Accordingly, the purifier is suitable for practical use as an exhaust gas purifier for an engine.

What is claimed is:

1. An exhaust gas purifier attached to a discharge passage for exhaust gas which is discharged by operation of an engine, said exhaust gas purifier comprising:

an outer case;

a filter installed in said outer case, said filter including at least two cylindrical filter elements each formed of porous metal, said filter elements being different in diameter from each other, and arranged concentric to each other to form a space between radially adjacent two of said at least two filter elements, said filter having an exhaust gas inlet passage side end and an exhaust gas outlet passage side end, a first shielding plate provided on said exhaust gas inlet passage side end of said filter to close that end up to a radially outermost one of said at least two filter elements;

a second shielding plate provided on said exhaust gas outlet passage side end of said filter to close a gap between an end of a radially innermost one of said filter elements and an inner wall of said outer case; and a plate heater disposed between said radially outermost one of said at least two filter elements and one of said at least two filter elements adjacent said radially outermost one without electrically contacting with said outermost one and adjacent one of said at least two filter elements, wherein three-dimensional porous metal having the same average pore-size is used as a material for each of said at least two filter elements.

2. An exhaust gas purifier attached to a discharge passage for exhaust gas which is discharged by operation of an engine, said exhaust gas purifier comprising:

an outer case;

a filter installed in said outer case, said filter including at least two cylindrical filter elements each formed of porous metal, said filter elements being different in diameter from each other, and arranged concentric to each other to form a space between radially adjacent two of said at least two filter elements, said filter having an exhaust gas inlet passage side end and an exhaust gas outlet passage side end, a first shielding plate provided on said exhaust gas inlet passage side end of said filter to close that end up to a radially outermost one of said at least two filter elements;

a second shielding plate provided on said exhaust gas outlet passage side end of said filter to close a gap between an end of a radially innermost one of said filter elements and an inner wall of said outer case; and a plate heater disposed between said radially outermost one of said at least two filter elements and one of said at least two filter elements adjacent said radially outermost one without electrically contacting with said outermost one and adjacent one of said at least two filter elements, wherein radial thicknesses of said at least two filter elements are reduced as diameters of said at least two filter elements become larger.

* * * * *